United States Patent [19]

Golembeck et al.

[11] 4,217,840

[45] Aug. 19, 1980

[54] ZIPPER SEWING ATTACHMENT AND METHOD

[75] Inventors: Gerald A. Golembeck, Lake Elmo; Eugene D. Wilwert, Cottage Grove, both of Minn.

[73] Assignee: The United States Bedding Company, St. Paul, Minn.

[21] Appl. No.: 894,940

[22] Filed: Apr. 10, 1978

[51] Int. Cl.[2] ..... D05B 3/12; D05B 35/06

[52] U.S. Cl. ..... 112/265.2

[58] Field of Search ..... 112/265.2, 130, 104, 112/105, 70, 77, 76, 106, 107, 113, 120, 147; 2/265

[56] References Cited

U.S. PATENT DOCUMENTS

| | | | |
|---|---|---|---|
| 3,633,528 | 1/1972 | Frohlich | 112/265 |
| 3,685,474 | 8/1972 | Frohlich et al. | 112/265 |
| 3,710,745 | 1/1973 | Yoshikawa | 112/265 |

FOREIGN PATENT DOCUMENTS

| | | | |
|---|---|---|---|
| 1415694 | 11/1975 | United Kingdom | 112/104 |

*Primary Examiner*—Werner H. Schroeder
*Assistant Examiner*—Andrew M. Falik
*Attorney, Agent, or Firm*—McDougall, Hersh & Scott

[57] ABSTRACT

A method and apparatus for applying a zipper to a length of material. The system involves the feeding of the material to a sewing machine while simultaneously locating separate zipper tape sections on the material whereby the tape sections are attached to the material. These sections are attached with the teeth supporting edges thereof facing outwardly and with the opposite edges thereof facing inwardly and being positioned adjacent each other. The material is then cut along a line adjacent these opposite edges whereby the material is formed into separate pieces. Thereafter, the teeth supporting edges are folded back toward each other whereby the material can be rejoined by the zipper. The apparatus preferably includes a spreading device to hold the opposite edges of the zipper in spaced relationship during the cutting operation whereby the cutter will not engage the tape. The zipper sections are preferably fed from a source which involves joined sections. A separator is utilized for opening the zipper, and guide means then reverse the section positions whereby the teeth supporting edges and free edges are properly positioned as the sections are fed to the sewing machine.

16 Claims, 7 Drawing Figures

FIG. 4
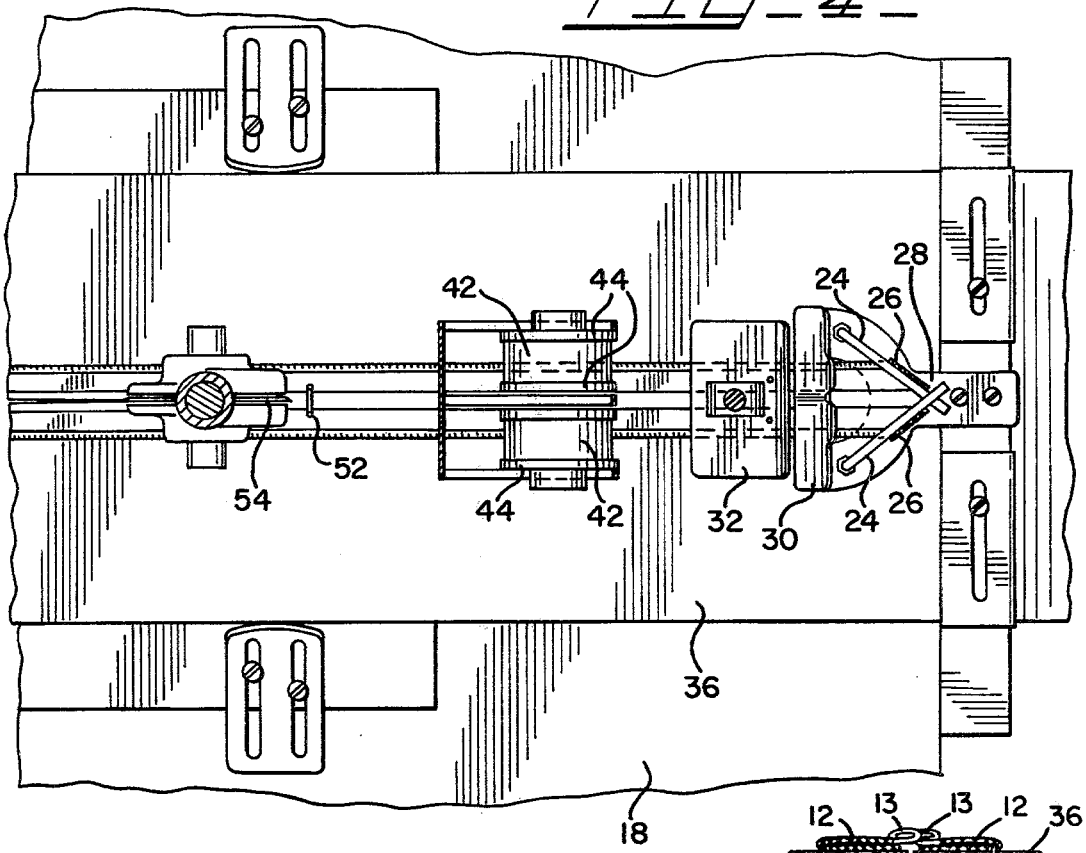
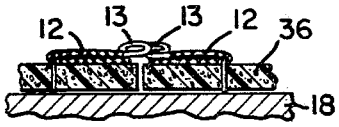
FIG. 8
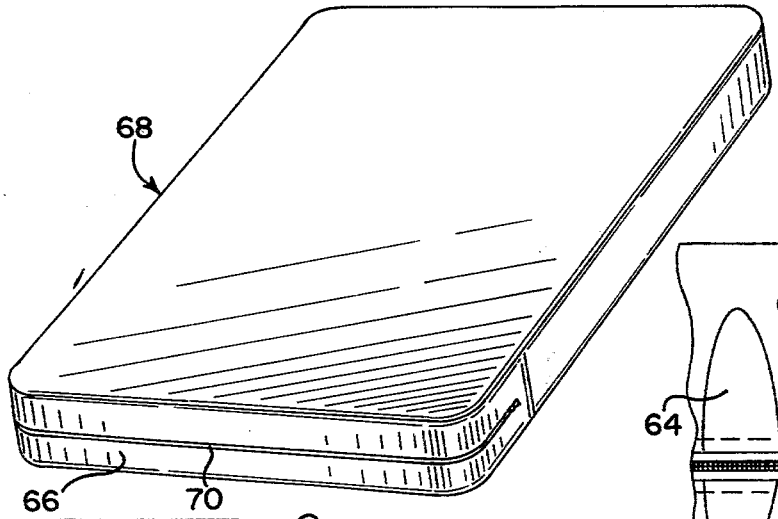
FIG. 6
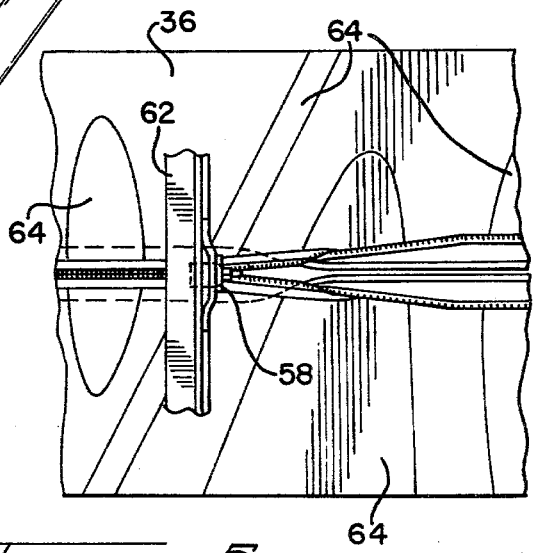
FIG. 5
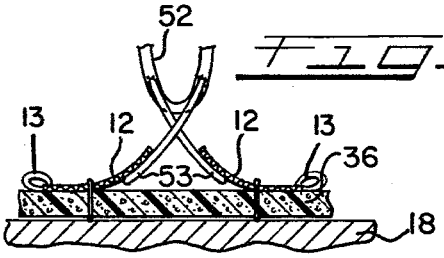
FIG. 7

ZIPPER SEWING ATTACHMENT AND METHOD

BACKGROUND OF THE INVENTION

1. Field of the Invention

This invention relates to the application of zippers to lengths of material. The invention will be described with reference to the application of a zipper to material intended for forming the end panel in a mattress construction. Such constructions utilize a mattress cover having one end panel with a zipper opening whereby the insertion of the mattress filler is facilitated. It will be understood, however, that other uses for the system of the invention are contemplated.

The invention finds particular utility in the application of zippers to materials which define a pattern. An important aspect of the invention involves the application of a zipper to a length of material in a fashion such that the separate pieces of material, when rejoined by the zipper, will automatically achieve matching of the pattern portions in the respective pieces.

2. Description of the Prior Art

Standard zipper constructions comprise separate tape sections with each section having one edge supporting the zipper teeth. The tape sections also include portions extending away from these edges whereby a sewing machine or the like can be utilized for attaching the tape sections to a fabric or other material. In a typical operation, two separate pieces of material are each provided with a tape section, and the pieces can then be joined by utilizing a zipper closer.

Problems arise where the material defines a pattern since for most suitable appearance, the pattern portion of one piece should match the pattern portion of a separate piece when the pieces are joined. Ordinary practice involves cutting the material and applying the zipper tape sections in a fashion such that the patterns can be matched. Particularly in the case of a mass production operation, exact matching can be time-consuming. Accordingly, where high production rates are desired, the matching is often sacrificed.

SUMMARY OF THE INVENTION

In accordance with the system of this invention, zippers are applied to lengths of material by feeding the uncut material to a sewing machine. Respective zipper tape sections are located in position whereby the machine sews the sections to the uncut material. The method and apparatus locate the tape sections, however, in a reverse position; that is, the teeth supporting edges of the sections face outwardly with the respective opposite edges of the tape sections facing inwardly and being located adjacent each other.

After sewing of the tape sections to the material, the material is cut along the line adjacent the inwardly facing opposite edges. A spreading tool is preferably utilized for holding these edges out of position relative to the cutter in order to avoid engagement of the cutter with the tape sections.

The preferred form of the invention also contemplates the use of a means for folding the teeth supporting edges of the tape sections back toward each other as the material is withdrawn from the cutter. A stationary zipper closer is provided at this position whereby the material pieces are automatically rejoined as the material emerges from the apparatus.

Since the rejoining of the material preferably takes place as a step immediately following cutting of the material, the rejoined material pieces will automatically have the same relationship as existed prior to cutting of the material. Accordingly, pattern matching will be automatically developed. This matching condition is also automatically maintained since the zipper remains closed during subsequent operations wherein the material is severed into desired sizes for subsequent use, and wherein the zipper ends and closers are applied in conventional fashion.

BRIEF DESCRIPTION OF THE DRAWINGS

FIG. 4 is an enlarged, fragmentary, horizontal sectional view taken along the line 4—4 of FIG. 2;

FIG. 5 is an enlarged, fragmentary, horizontal, sectional view taken along the line 5—5 of FIG. 2;

FIG. 6 is a perspective view of a mattress construction incorporating a zipper applied by the system of this invention;

FIG. 7 is an enlarged detailed view illustrating the spreader structure utilized in the apparatus; and FIG. 8 is an enlarged detailed view illustrating the material after cutting and rejoining of the zipper.

DESCRIPTION OF THE PREFERRED EMBODIMENT

The drawings illustrate a combination of structures making up the apparatus of this invention. This apparatus includes a first reel 10 providing a supply of zipper tape 12 of conventional design including coil fastener elements 13. A second reel 14 is utilized for taking up the material to which the zipper is applied, and this second reel may be driven to provide some motive force during the operation of the apparatus. The supply reel 10 and the source of the material (not shown) may comprise idler reels.

Figure 1:
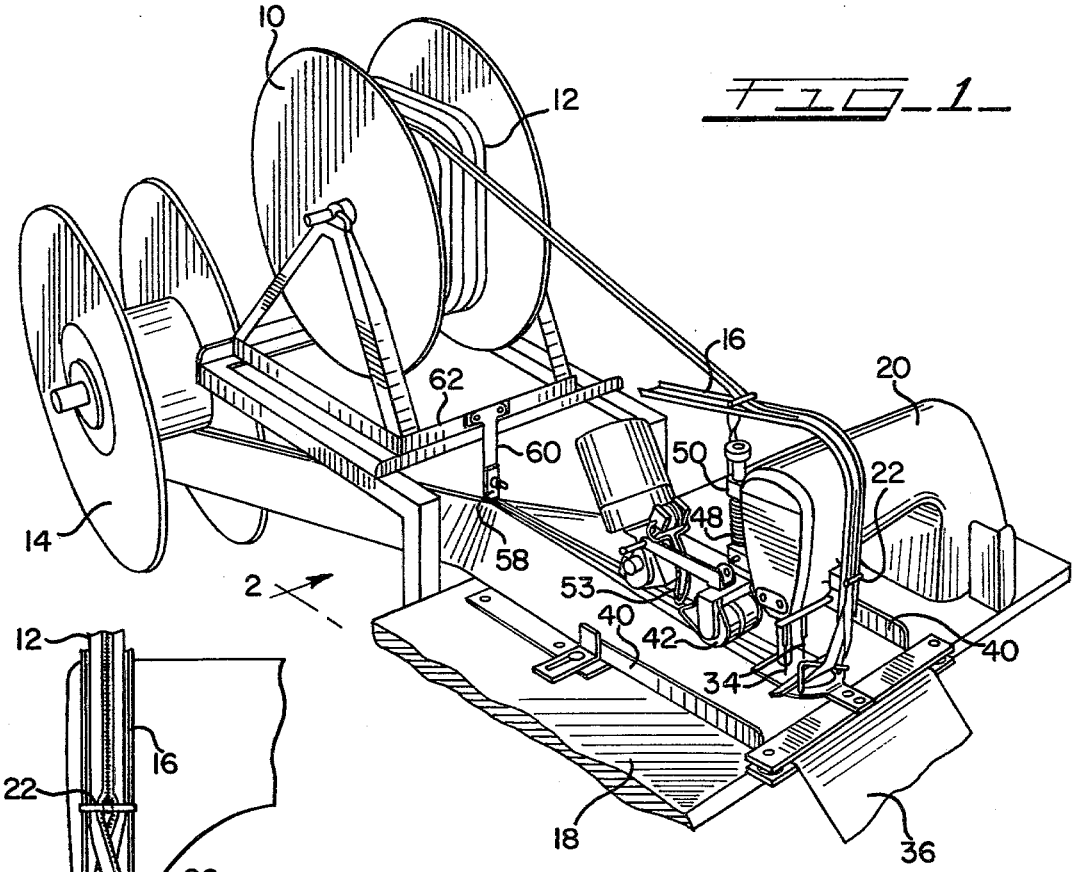
FIG. 1 is a perspective view of the zipper sewing apparatus of this invention.
Figure 3:
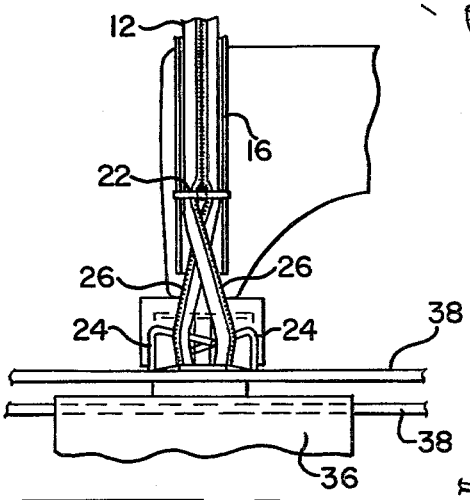
FIG. 3 is a fragmentary end view of the apparatus taken along the line 3—3 of FIG. 2.
Figure 2:
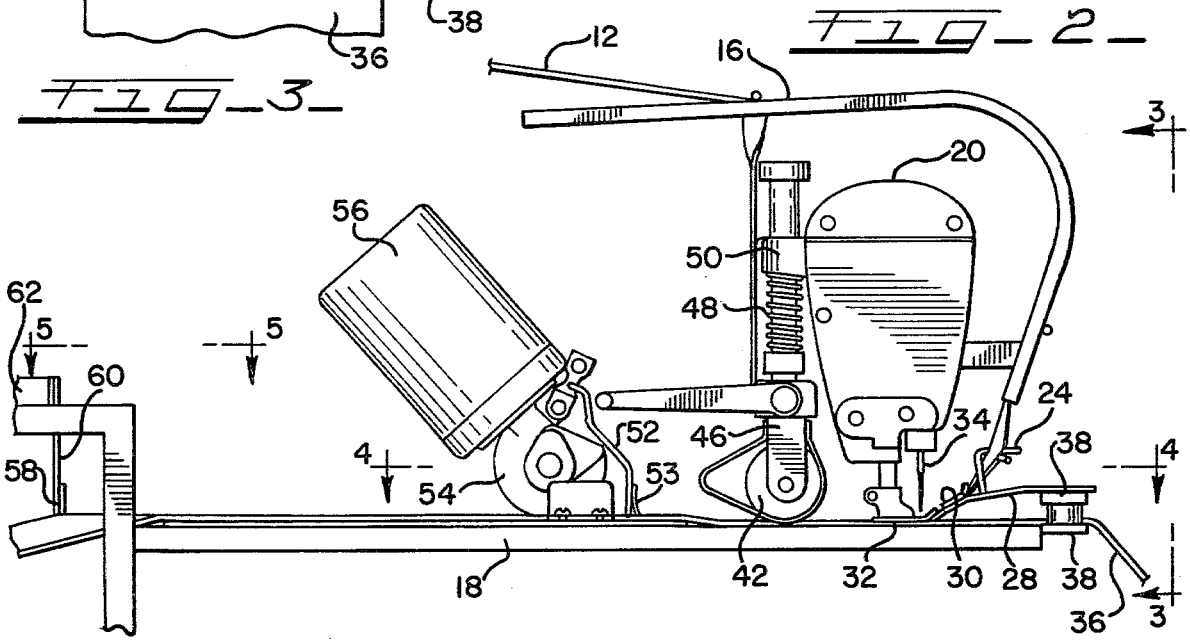
FIG. 2 is a fragmentary, side elevation of the apparatus taken along the line 2—2 of FIG. 1.

The zipper tape is conventionally supplied with the respective teeth in engagement, that is, the tape sections are closed. The tape is, therefore, delivered to a channel member 16 which curves downwardly toward the bed 18 which supports sewing machine 20. A zipper opening pin is located at 22 whereby the tape sections are separated as shown in FIG. 3. The respective tape sections are then moved into engagement with guide wire elements 24.

As illustrated, the guide wire elements 24 cause the respective tape sections to cross whereby the teeth supporting edges 26 of these sections are disposed outwardly. The opposite edges of the tape sections are thus located inwardly and in facing relationship.

The bracket 28 which supports the guide wires also carries a cross member 30, and the tape sections are moved beneath this cross member. This directs the tape sections to plate 32 conventionally associated with the sewing machine whereby the sections can be engaged by needle 34.

The material 36 to which the tape sections are to be sewn is led between upper and lower bars 38, and this material is then directed beneath the plate 32 while being engaged by the tape sections. A pair of upstanding side guides 40 serve to confine the edges of the material 36 whereby the tape sections will be applied to the material along a substantially straight line.

After sewing of the tape sections, the combined tape and material are drawn over the bed 18 by means of puller rolls 42. These rolls each define rim portions 44 of larger diameter, the rim portions engaging the underlying tape and material. The smaller diameter central portions of the rollers prevent damage to the teeth of the zipper tape.

The rollers 42 are supported on bracket 46 which is pressed downwardly by means of spring 48. This spring is engaged at its upper end by fitting 50 secured to the wall of machine 20. The drive for the rollers 42 is provided in a conventional fashion.

Immediately beyond the puller structure, there is provided a spreader consisting of a pair of downwardly and outwardly extending wires 52. These wires are resilient and are attached, as by soldering, to a sturdier wire support 52. When the wires 52 require replacement due to wear or other damage, they can be readily removed and fresh wires soldered in place.

The spreader with wires 52 serves to force the inward portions of the tape sections upwardly as best shown in FIG. 7. This prepares the combination for movement into engagement with the cutter blade 54 which is driven by motor 56. It will be noted in particular that the spreader operates to hold the tape portion out of position relative to the adjacent material and, in this fashion, damage to the zipper by the cutter is avoided. In order to more easily achieve this function, the stitches applied by the sewing machine are substantially outwardly of the free edges of the tape sections and are preferably closer to the teeth supporting edges than to the free edges. This provides a free tape section of sufficient width to insure engagement by the spreader wires 52.

As the material is moved through the cutter, it is separated into two pieces. Located beyond the cutter at the end of tape 18, there is provided a stationary zipper closer 58. This closer is supported on a downwardly extending arm 60 which is, in turn, connected to the frame member 62. The closer is of conventional design, and the details thereof are, therefore, not illustrated. The closer may, for example, be of the type shown in Yoshikawa U.S. Pat. No. 3,710,745 with an appropriate support for holding the closer in a stationary position.

The material 36 is, thus, rejoined by means of the applied zipper, and this material can then be pulled onto reel 14. The reel supporting structure may be such that the material could be severed crosswire when the reel is full, and a new reel located in position without interrupting the operation. As indicated, this reel may be driven although it is not necessary that it provide the pulling force as the material and zipper are drawn through the apparatus.

In the operation of the construction, the material may be manually directed to the sewing position along with the zipper tape sections, and manual assistance may also be utilized for initially directing the combination through closer 58. It will be appreciated, however, that once the operation is initiated, the various functions are all automatically accomplished. The guide wires 24 and the spreader wires 52 will, in particular, function automatically since these are stationary members which will achieve the crossing and spreading functions automatically once the operation is commenced. It will, therefore, be appreciated that the advantages of the invention are achieved through the utilization of operating elements of a highly reliable character.

It will be appreciated that with the system described, the material 36 is rejoined in a fashion such that the separate pieces of material are in precise relationship from the standpoint of pattern matching. Specifically, since the zipper sections are applied before the material is cut, and since the zipper sections are than rejoined before the material leaves the apparatus, the matching of the pieces is automatically achieved. The material 36 shown in FIG. 5 illustrates different patterned areas 64 which are maintained in matched relationship in the manner described.

As shown in FIG. 6, the invention has utility with respect to the formation of end panels 66 associated with a mattress 68. These end panels conventionally have a zipper 70 which is provided so that the mattress cover can be closed after the mattress filler has been inserted. Since the mattress cover material usually will display some sort of pattern, this invention provides a highly efficient means for maintaining the best appearance in such mattresses.

It will also be appreciated that the apparatus and method of this invention can be utilized for the application of zippers in many other instances particularly where high production rates are desired and where pattern matching is important.

It will be understood that various changes and modifications may be made in the above described system which provide the characteristics of this invention without departing from the spirit thereof particularly as defined in the following claims.

That which is claimed is:

1. In a method for applying a zipper to a length of material, the zipper comprising separate tape sections with each tape section supporting mating teeth along an edge, each tape section being ultimately applied to a separate piece of material whereby the zipper can be utilized to secure the pieces of material together, the improvement comprising the steps of continuously feeding said material to a sewing machine, said material being in an unseparated condition, continuously feeding said tape sections to said machine, locating said tape sections on said material with said teeth supporting edge of each section facing outwardly and with the opposite edge of each section facing inwardly and being positioned adjacent each other, sewing said tape sections to said material, thereafter cutting said material along a line adjacent said opposite edges to thereby form said separate pieces of material, folding said teeth supporting edges back toward each other, and joining said teeth to secure the pieces of material together.

2. A method in accordance with claim 1 wherein said tape sections are initially fed in a joined condition, and including the step of separating said tape sections prior to feeding of the tape sections to the sewing machine.

3. A method in accordance with claim 2 including the step of reversing the positions of said tape sections after separation thereof for thereby locating said teeth supporting edges in an outwardly facing position prior to feeding to said sewing machine.

4. A method in accordance with claim 1 wherein said material is cut as the material exits from said sewing machine.

5. A method in accordance with claim 4 including the step of spreading said opposite edges apart at a position immediately adjacent the means for cutting the material whereby the cutting means will not engage the tape sections.

6. A method in accordance with claim 5 wherein the stitches sewn by said machine are located in a position substantially outwardly of said opposite edges whereby substantial portions of said tape sections are adapted to be spread apart.

7. A method in accordance with claim 1 including the step of continuously withdrawing said material after cutting, locating a stationary zipper closer intermediate the withdrawing means and the cutting means, and continuously pulling said tape sections through said closer whereby said material is rejoined during said withdrawings.

8. A method in accordance with claim 7 wherein the provision of said stationary closer operates to automatically fold the teeth supporting edges of said tape sections inwardly toward each other as said material is withdrawn.

9. A method in accordance with claim 7 wherein said material defines a pattern, cutting of the material operating to separate matching portions of the material, and rejoining of said zipper sections operating to rematch the pattern portions of the material.

10. A method in accordance with claim 9 wherein said material comprises the end panel of a mattress cover, the zipper of the end panel permitting insertion of a filler into the mattress cover when the end panel is joined with the mattress cover.

11. In an apparatus for applying a zipper to a length of material, the zipper comprising separate tape sections with each tape section supporting mating teeth along an edge, and a sewing machine for applying the tape sections to said material, each tape section being ultimately applied to a separate piece of material whereby the zipper can be utilized to secure the pieces of material together, the improvement comprising means for continuously feeding said material and said tape sections to said sewing machine, said material being in an unseparated condition, means for holding said tape sections in a position such that the teeth supporting edges of each section face outwardly and the opposite edges of each section face inwardly while being positioned adjacent each other, said sewing machine applying said tape sections to said material with said teeth supporting edges facing outwardly, cutting means positioned beyond said sewing machine for cutting said material along a line adjacent said opposite edges whereby said separate pieces of material are formed, and zipper closer means positioned beyond said cutting means operating to fold said teeth supporting edges back toward each other whereby the zipper sections are joined to secure the pieces of material together.

12. An apparatus in accordance with claim 11 including supply means for supplying a continuous length of the tape sections, the tape sections being joined when fed from the supply means, and including means for separating said tape sections prior to feeding to said sewing machine.

13. An apparatus in accordance with claim 12 including means positioned between said separating means and said sewing machine for reversing the edge positions of the tape sections to locate the respective teeth supporting edges outwardly and the respective opposite edges adjacent each other.

14. An apparatus in accordance with claim 11 wherein said cutting means comprises a cutter blade positioned beyond said sewing machine.

15. An apparatus in accordance with claim 14 including spreader means positioned forwardly of said cutter blade operating to force said opposite edges away from each other prior to engagement of the cutter blade with said material whereby the cutter blade will not engage the tape sections.

16. An apparatus in accordance with claim 11 wherein said material comprises a panel defining a pattern, the zipper closer means operating to return the material pieces to substantially the same relative positions whereby the pattern of the material is substantially matched after application of the zipper.

* * * * *